United States Patent [19]

Rodaway

[11] 3,990,745

[45] Nov. 9, 1976

[54] WHEELCHAIR WITH REMOVABLE BACK

[75] Inventor: Keith Samuel Rodaway, Santa Monica, Calif.

[73] Assignee: Everest & Jennings, Inc., Los Angeles, Calif.

[22] Filed: Nov. 3, 1975

[21] Appl. No.: 628,196

[52] U.S. Cl. ..... 297/444; 248/355; 248/410; 297/DIG. 4; 403/377

[51] Int. Cl.[2] ..... A47C 7/00

[58] Field of Search ..... 248/410, 354, 355; 297/42, 416, 443, 444, DIG. 4; 403/377

[56] References Cited

UNITED STATES PATENTS

| | | | |
|---|---|---|---|
| 2,428,190 | 9/1947 | Akse | 297/444 X |
| 2,668,584 | 2/1954 | Greitzer | 297/444 |
| 2,849,204 | 8/1958 | Petrick et al. | 248/410 |
| 3,734,441 | 5/1973 | Lux | 248/410 X |
| 3,896,891 | 7/1975 | Miltenburd et al. | 297/DIG. 4 |

*Primary Examiner*—James C. Mitchell
*Attorney, Agent, or Firm*—Ralph B. Pastoriza

[57] ABSTRACT

Rear left and right vertically disposed wheelchair frame tubes are arranged to telescopically receive left and right back rest tubes supporting the main back rest portion of the wheelchair. The lower ends of the back rest tubes include downwardly directed rods spaced to the sides of the tubes and designed to be received in appropriate binding structures secured to the wheelchair frame to automatically lock the back rest tubes to the frame to position the back rest itself properly for a patient. The binding elements may easily be manually released to permit telescopic removal of the back rest tubes from the wheelchair frame itself.

1 Claim, 5 Drawing Figures

WHEELCHAIR WITH REMOVABLE BACK

This invention relates generally to wheelchairs and more particularly to an improved back rest assembly designed to be easily removed from or inserted onto the wheelchair frame.

BACKGROUND OF THE INVENTION

Most wheelchairs are of the foldable type so that they can be readily stored in the trunks of automobiles and the like. Normally, all that is necessary is that the seat and back rest be of flexible canvas material so that they can fold, the main wheels of the wheelchair then being brought close together in side-by-side relationship. In this repect, the wheelchair frame itself generally includes crossed tubular members which can be scissored together when the wheelchair is in its collapsed or folded state.

While the foregoing folding operation reduces substantially the effective width of the wheelchair for storage purposes, the overall height of the chair as measured from the bottom of the main wheels to the upper hand grips on the back rest portion remains the same or in many instances is increased as a consequence of the scissoring action of the main frame structure. Attempts to avoid increasing the overall height of the collapsed chair have taken the form of providing telescoping crossed tubes for the main frame structure which will permit a scissoring action without increasing to any appreciable extent the referred to height.

Another means for rendering the chair more compact in the height direction would be to provide a removable back structure wherein the back tubes and hand grip portions could be removed thus greatly reducing the overall height when the chair is in collapsed position. While the problem is solved by the provision of a removable back, other problems are introduced. Principal among these problems is that of making certain a secure coupling is achieved when the back rest is reassembled on the wheelchair.

It will be appreciated with respect to the foregoing that when a wheelchair is operated by an attendant or nurse, the movement thereof is transmitted through the hand grips on the back rest structure. When the chair is manipulated over ridges or up and down ramps, large tensions can develop in the back rest frame tubes relative to the remaining frame structure and should the removable coupling means for the back rest fail such that the back rest separates from the main frame structure, disastrous results can occur to the patient in the wheelchair.

In addition to the foregoing problem, the inner coupling means for a removable back rest and wheelchair frame should be simple, economical to manufacture, and avoid bulkiness in its construction. Moreover, it should be easy for an attendant or nurse to operate and most importantly, it should be designed as to virtually render impossible inadvertent separation.

BRIEF DESCRIPTION OF THE PRESENT INVENTION

With the foregoing considerations in mind, the present invention contemplates a wheelchair with a removable back such that the same may be folded into a compact configuration and yet wherein the reassembly of the back rest onto the wheelchair frame is simple and most importantly secure so that inadvertent uncoupling is virtually impossible.

Briefly, the invention provides rear left and right upwardly extending frame members constituting part of the wheelchair frame structure. The wheelchair back rest includes left and right back rest members telescopically coupled to the frame members so that the back rest members can be lifted from the frame members for removal. Cooperating locking means on the back rest and frame members automatically lock the members together in telescoped relationship in response to telescoping the back rest members downwardly with respect to the frame members, these cooperating locking means including binding means secured to the frame members in such a manner that the back rest members are locked against upward movement, the greater the upward force, the greater the locking action. On the other hand, the binding means are so designed that they can be manually operated to release the back rest members from the frame members and thereby permit easy removal of the back rest.

BRIEF DESCRIPTION OF THE DRAWINGS

A better understanding of this invention will be had by referring to a preferred embodiment thereof as illustrated in the accompanying drawings in which.

DETAILED DESCRIPTION OF THE PREFERRED EMBODIMENT

Figure 1:
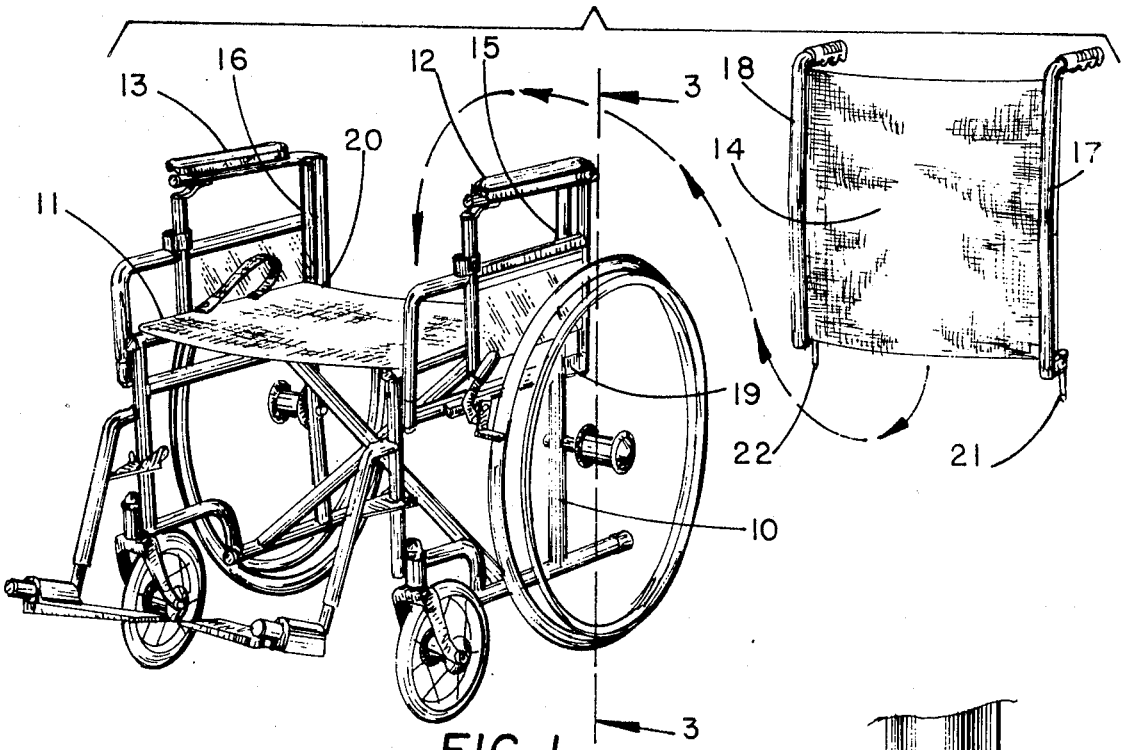
FIG. 1 is a front three quarter perspective view of a wheelchair having a removable back rest wherein the back rest itself is shown in exploded removed relationship to the chair.

Referring first to FIG. 1 there is shown a wheelchair frame structure 10 supporting a seat 11 and arm rests 12 and 13 on the left and right sides of the seat respectively. A back rest 14 is shown removed from the wheelchair frame 10.

The assembly providing for the feature of a removable back rest includes rear left and right upwardly extending parallel frame tubes 15 and 16 adjacent the respective rear left and right corners of the seat 11. These frame tubes constitute a part of the wheelchair frame itself and terminate at their upper ends at approximately the level of the arm rests 12 and 13 as shown.

The back rest 14 which, as stated, is shown separated from the wheelchair, in turn includes left and right back rest tubes 17 and 18 of sufficient internal diameters to be telescopically receivable over the rear left and right frame tubes 15 and 16 to thereby position the back rest 14 properly for use by a patient seated in the wheelchair.

In order to secure the back rest tubes 17 and 18 in telescoped relationship with the frame tubes 15 and 16, there are provided cooperating left and right locking means on the rear walls of the frame tubes and the lower rear end walls of the back rest tubes respectively. The portions of the locking means on the frame tubes take the form of binding means designated 19 and 20 while the portions of the locking means on the back rest tubes 17 and 18 take the form of vertically downwardly extending rod elements 21 and 22 offset from the axis of the tubes as shown in FIG. 1.

Since the locking means associated with the left frame tube 15 and left back rest tube 17 are the same as those associated with the right frame tube 16 and right back rest tube 18, description of one will suffice for both.

Figure 2:
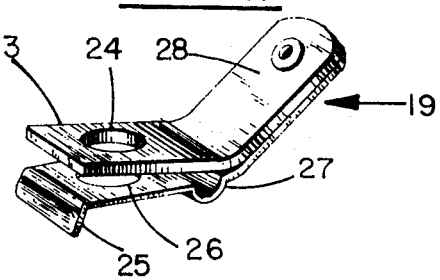
FIG. 2 is an enlarged perspective view of a binding means constituting part of the locking means for the wheelchair back rest.

Thus, referring to FIG. 2 there is shown a major portion of the binding means 19 associated with the left frame tube 15 of FIG. 1. This binding means includes an upper plate member 23 having an opening 24. A lower plate member 25 extends beneath the upper plate member as shown and has an opening 26 which can be brought into axial alignment with the opening 24 in the upper plate member when the plate members are parallel to each other.

As shown in FIG. 2, the plate members 23 and 25 are secured together along adjacent edges as at 27 and are biased apart so that the planes of the openings are at an acute angle to each other. In the embodiment of FIG. 2, the upper plate 23 includes a lateral portion 28 bent out of the plane of the remaining portion of the plate as shown. Both of the plates 23 and 25 may be made of spring steel.

Figure 3:
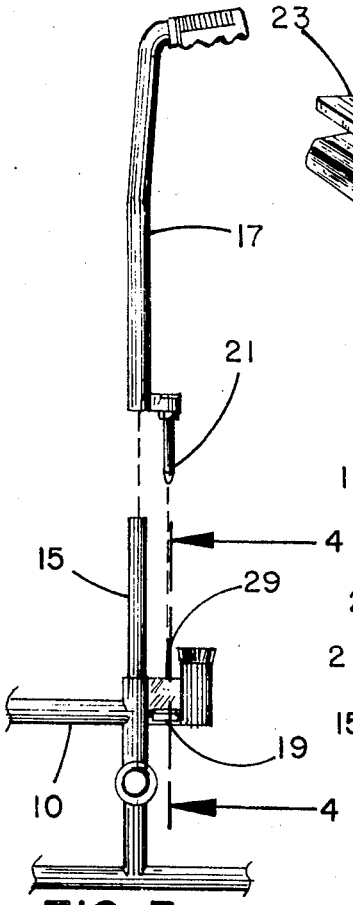
FIG. 3 is an enlarged fragmentary side elevational view looking in the direction of the arrows 3—3 of FIG. 1 showing the back rest in a position preparatory to being coupled to the wheelchair frame.

Referring now to FIG. 3, the binding means 19 described in FIG. 2 is partially visible within a receiving structure 29 secured to the rear wall of the associated frame tube 15. The left back rest tube 17 with its cooperating locking rod element 21 is shown above the frame tube 15 preparatory to being received thereon. Essentially, the spacing of the rod element 21 is such that when the back rest tube 17 is telescopically lowered over the frame tube 15, the rod 21 will be received in the binding means 19 secured in the receiving structure 29.

Figure 4:
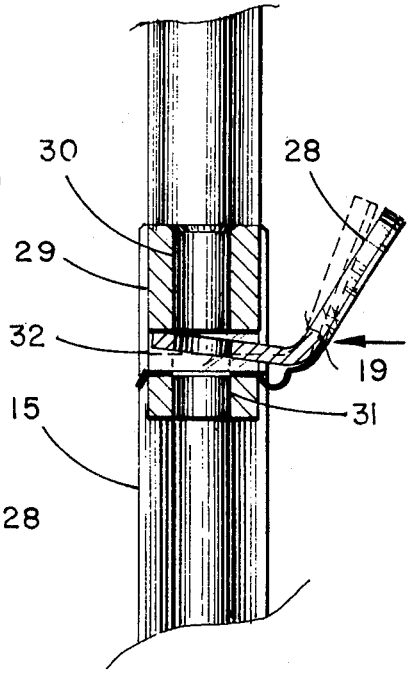
FIG. 4 is an enlarged fragmentary cross sectional view taken in the direction of the arrows 4—4 of FIG. 3; and, FIG. 5 is a view similar to FIG. 4 showing one of the back rest tubes in locked relationship to one of the wheelchair frame tubes.

FIG. 4 illustrates in greater detail the cooperation between the receiving structure 29 and binding means 19. As shown, the receiving structure has upper and lower openings 30 and 31 in axial alignment and a central cut-out portion 32 serving to receive the plate members making up the binding means 19.

Figure 5:
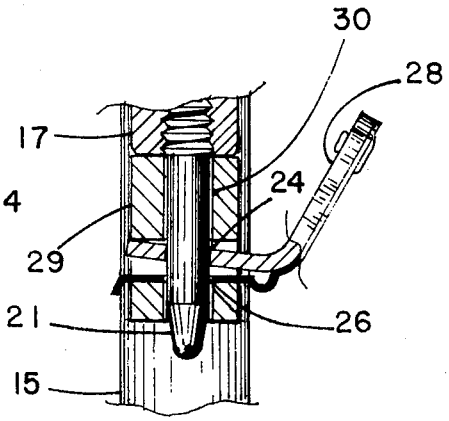

Referring now to FIG. 5, the cooperating action of the rod element 21 on the back rest tube 17 when the same is telescoped over the frame tube 15 with the binding means is illustrated. Thus, as the back rest tube is telescoped downwardly, the rod element passes through the upper opening 30 in the receiving stucture 19 and thence through the openings 24 and 26 in the plate members to bias the plate members towards a parallel relationship. Since the plate members are normally biased to form an angle with each other, the peripheral edges of the openings 24 and 26 will bind or grip against the rod element 21 to secure the rod element against withdrawal. In fact, it will be appreciated that the greater the upward force exerted on the rod element 21 in an attempt to withdraw the back rest tube 17 the greater will be the gripping or binding force exerted by the plate members since such withdrawal will tend to separate the plate members thereby increasing the acute angle between the planes of the respective openings 24 and 26.

It will also be appreciated from the foregoing description that when the back rest tubes are lowered over the frame tubes, the rod elements can readily pass into the openings without requiring any further manual manipulation. In other words, the locking is self actuating or automatic.

To permit removal of the rod element such as element 21 from the binding means and receiving structure, it is only necessary to manually urge inwardly the laterally extending portion 28 of the upper plate making up the binding means. Thus, with reference once again to FIG. 4, a manual inward pressure on the laterally extending portion 28 will tend to lower the upper plate towards the lower plate thereby bringing the respective openings into coaxial alignment and thus permitting release of the rod 21. This movement is indicated in dotted lines in FIG. 4, the lower plate of the binding means being blocked from moving away from the upper plate when the upper plate is biased as described by its engagement with the floor of the cut out portion 32 of the receiving structure 29.

It is also to be appreciated from FIGS. 1 and 3 that the main frame tubes 15 and 16 telescopically receiving the back rest tubes 17 and 18 extend upwardly a substantial distance so that there is a large overlap of the telescoping portions. There is thus no sacrifice in strength in the overall coupling of the back rest to the wheelchair frame; that is, the wheelchair back rest can handle a large bending load which is required in manipulating the wheelchair frame itself by means of the grips on the back rest tubes.

Moreover, and as already mentioned, upward movement of the back rest tubes 17 and 18 which might result in inadvertent separation of the back rest from the remaining portion of the wheelchair is virtually impossible because of the locking action of the binding means on the rod element 21. As pointed out, the greater the upward force exerted on the back rest tubes 17 and 18, the greater will be the binding action.

In addition to the foregoing features, it will be appreciated generally that the locking means as described is relatively simple, not bulky, and inexpensive to manufacture. Should the binding means such as indicated at 19 in FIG. 2 itself become worn or damaged, it is a simple matter to replace the same in the receiving structure 29 by simply biasing the plates together and sliding the same out from the cut out. It will be understood that the binding means is retained in place as a consequence of the biasing apart of the plate members so that the upper and lower plate members engage respectively the top and bottom portions of the cut out in the receiving structure 29.

From the foregoing description, it will thus be evident that the present invention has provided an improved wheelchair with removable back rest such that the same can readily be folded into a more compact configuration than is possible with foldable wheelchairs wherein the back rest is fixed to the chair frame.

What is claimed is:

1. In combination with a wheelchair frame structure supporting a seat and arm rests on the left and right sides of the seat, a removable back rest assembly including, in combination:

a. rear left and right upwardly extending parallel frame tubes adjacent the respective rear left and right corners of said seat, said frame tubes terminating at approximately the level of said arm rests;

b. a back rest including left and right back rest tubes telescopically receivable over said rear left and right frame tubes for supporting the main portion of the back rest to the wheelchair frame in proper position for a patient; and c. cooperating left and right locking means on the rear walls of said frame tubes and the lower end walls of said back rest tubes respectively, each of said locking means including: a binding means comprised of an upper plate member having an opening; a lower plate member extending beneath the upper plate member and having an opening axially aligned with said opening in the upper plate member when the plate members are parallel to each other, said plate members being secured together along adjacent edges with their opposite edges biased apart so that the planes of the openings are at an acute angle to each other; a receiving structure secured to the rear wall of an associated frame tube and having upper and lower openings in axial alignment and a central cut-out portion receiving said plate members such that when said plate members are urged into parallel relationship, their openings are in axial alignment with said upper and lower openings in said receiving structure; and a rod element secured to the lower rear end wall of an associated back rest tube in a position to pass through the upper opening in said receiving structure when the back rest tube is telescoped over the frame tube, said rod passing through the openings in the plate members to bias the plate members towards a parallel relationship, the peripheral edges of the openings in said plate members binding against said rod to secure the rod against withdrawal so that said back rest tubes are thereby locked to said frame tubes against upward movement, said upper plate member having a lateral portion bent out of the plane of the remaining portion extending from said cut-out such that it may be manually pressed to rock the upper plate towards a parallel position with respect to the lower plate, thereby aligning the plate openings so that said rod is released from said plates thereby permitting said back rest to be removed by telescoping the same upwardly with respect to the frame tubes.

* * * * *